US011051623B2

(12) United States Patent
Kamber

(10) Patent No.: US 11,051,623 B2
(45) Date of Patent: Jul. 6, 2021

(54) BACKREST DEVICE

(71) Applicant: VITRA PATENTE AG, Birsfelden (CH)

(72) Inventor: Thomas Kamber, Basel (CH)

(73) Assignee: VITRA PATENTE AG, Birsfelden (CH)

( * ) Notice: Subject to any disclaimer, the term of this patent is extended or adjusted under 35 U.S.C. 154(b) by 29 days.

(21) Appl. No.: 16/342,942

(22) PCT Filed: Oct. 17, 2017

(86) PCT No.: PCT/EP2017/076438
§ 371 (c)(1),
(2) Date: Apr. 17, 2019

(87) PCT Pub. No.: WO2018/073223
PCT Pub. Date: Apr. 26, 2018

(65) Prior Publication Data

US 2020/0037766 A1 Feb. 6, 2020

(30) Foreign Application Priority Data

Oct. 18, 2016 (EP) ..... 16194436

(51) Int. Cl.
*A47C 7/44* (2006.01)

(52) U.S. Cl.
CPC ..... *A47C 7/44* (2013.01)

(58) Field of Classification Search
CPC ..... A47C 7/402; A47C 7/44
See application file for complete search history.

(56) References Cited

U.S. PATENT DOCUMENTS 3,526,430 A * 9/1970 Bender ..... A47C 7/402 297/353
5,044,666 A * 9/1991 Griesemer ..... B60R 22/202 248/297.31

(Continued)

FOREIGN PATENT DOCUMENTS

DE 20 2007 010 063 U1 9/2007
EP 2 005 861 A1 12/2008

(Continued)

OTHER PUBLICATIONS

International Search Report dated Dec. 12, 2017 in corresponding International Patent Application No. PCT/EP2017/076438.

*Primary Examiner* — David R Dunn
*Assistant Examiner* — Christopher E Veraa
(74) *Attorney, Agent, or Firm* — Medler Ferro Woodhouse & Mills PLLC

(57) ABSTRACT

A backrest device includes a backrest carrier having a support arm, a backrest mounted on the support arm, and an actuator that is adjustable between a blocking position and a movement position. The support arm is equipped with a latching row. The backrest is movable along the support arm. The actuator is connected to the backrest and has an engaging piece. In the blocking position, the engaging piece is engaged with the latching row, so that a movement of the backrest along the support arm is blocked. In the movement position, the engaging piece is disengaged from the latching row, so that the backrest is movable along the support arm. The actuator is manufactured in one piece from an elastic material, in the movement position the actuator being elastically deformed by a manually applied force, so that the engaging piece is moved out of the latching row.

13 Claims, 4 Drawing Sheets

(56) References Cited

U.S. PATENT DOCUMENTS

| | | | | | |
|---|---|---|---|---|---|
| 5,725,278 | A * | 3/1998 | Verbeek | A47C 7/402 | 297/353 |
| 5,853,222 | A * | 12/1998 | Roslund, Jr. | A47C 7/402 | 297/353 |
| 5,904,400 | A * | 5/1999 | Wei | A47C 1/03255 | 297/284.1 |
| 6,347,777 | B1 * | 2/2002 | Webber | A47C 7/402 | 248/188.5 |
| 7,275,790 | B2 * | 10/2007 | Chi | A47C 7/402 | 297/353 |
| 10,455,946 | B1 * | 10/2019 | Wang | A47C 7/462 | |
| 2003/0071506 | A1 * | 4/2003 | Burgin | A47C 7/402 | 297/353 |
| 2006/0131944 | A1 * | 6/2006 | Helmond | A47C 7/402 | 297/353 |
| 2008/0018154 | A1 * | 1/2008 | Chou | A47C 1/026 | 297/284.4 |
| 2011/0215623 | A1 * | 9/2011 | Tsai | A47C 7/405 | 297/301.1 |
| 2013/0043707 | A1 * | 2/2013 | Yoon | A47C 7/021 | 297/284.4 |

FOREIGN PATENT DOCUMENTS

| | | | |
|---|---|---|---|
| JP | S61-82452 | U | 5/1986 |
| WO | 98/09553 | A1 | 3/1998 |

* cited by examiner

BACKREST DEVICE

TECHNICAL FIELD

The invention relates to a backrest device according to the preamble of independent Claim 1. With such backrest devices, backrests may be provided with height adjustment in a piece of seating furniture, in particular an office chair.

BACKGROUND

Many pieces of seating furniture, in particular office chairs, are currently equipped with backrests that are provided to allow ergonomic seating. For this purpose, for example the backrests are connected to a chair base or a seat via a backrest carrier having two arms. The backrest carrier may thus allow on the one hand a resilient downward movement of the backrest, and on the other hand, a resilient movement in a lateral direction or a rotating movement to a certain extent.

Backrests are often height-adjustable to allow adaptation to a user. For example, EP 2 721 962 A1 describes a backrest in which a baseplate of a backrest is height-adjustably mounted on two webs of a backrest carrier that is connected to a seat. A dorsokinetic bearing that allows rotational movements is situated on the baseplate. For adjusting the height, the webs are each equipped with a row of latching structures. A locking lever, a button supported by springs, and a cover are mounted on the baseplate. The locking lever is designed to engage with the latching structures of the webs. The locking lever is disengaged from the latching structures by pressing the button upwardly against the elastic force. In this position, the baseplate may be moved upwardly and downwardly along the webs. As soon as the button is released, the springs press it downwardly, and the locking lever, possibly at another location, re-engages with the latching structures of the webs. In this position, the baseplate is once again fixedly connected to the webs, and thus, to the backrest carrier.

A disadvantage of devices for adjusting the height of backrests, such as the device described above, is that typically a relatively large number of components are present that must be assembled in a fairly complicated manner. This makes the manufacture of the chair backs or the chairs relatively complex and expensive. In addition, they are relatively difficult to maintain, for example when individual components must be replaced. Furthermore, such known devices are usually relatively cumbersome and bulky, which is often undesirable for esthetic reasons, among others.

The object of the present invention, therefore, is to propose a backrest device that can be installed and maintained relatively easily, and that takes up preferably little space.

DESCRIPTION OF THE INVENTION

The object is achieved according to the invention by a backrest device as defined in independent claim 1. Advantageous embodiment variants of the invention result from the dependent claims.

The essence of the invention is as follows: A backrest device for a piece of seating furniture, in particular an office chair, includes a backrest carrier having a support arm, a backrest mounted on the support arm, and an actuator that is adjustable between a blocking position and a movement position. The support arm of the backrest carrier is equipped with a latching row. The actuator is connected to the backrest and has an engaging piece. In the blocking position, the engaging piece of the actuator is engaged with the latching row of the support arm of the backrest carrier, so that a movement of the backrest along the support arm of the backrest carrier is blocked. In the movement position, the engaging piece of the actuator is disengaged from the latching row of the support arm of the backrest carrier, so that the backrest is typically movable quasi-vertically along the support arm of the backrest carrier.

The actuator is in particular manufactured in one piece from an elastic material, in the movement position the actuator being elastically deformed by a force that is typically manually applied, so that the engaging piece of the actuator is moved or pulled out of the latching row of the support arm of the backrest carrier.

The latching row may in particular be a row of latching elements, for example a row of teeth. The latching elements or the teeth may be shaped and dimensioned congruently with the engaging piece of the actuator.

The backrest may in particular be movable quasi-vertically, i.e., essentially upwardly and downwardly, along the support arm. The term "quasi-vertically" may refer to an orientation of the backrest. In addition to a precisely vertical direction, this term also encompasses directions that differ from same, as is the case in particular for different inclinations of the backrest.

The backrest may include a frame that bears or stretches a support structure such as a tray, a cloth, or a pad. In such an embodiment, the frame of the backrest may be mounted on the backrest carrier.

The engaging piece may be designed as a projection or as a tab. In particular, it may be dimensioned and shaped in such a way that it can engage with the latching row in quasi-flush alignment. The engaging piece may thus have a design that is congruent with the latching row, and a movement of the backrest along the support arm, in particular in both directions, may be blocked in the blocking position.

The support arm of the backrest carrier may have a tubular or post-like shape, and may be straight or also curved as necessary.

The term "manually applied force" may indicate in particular that a user actuates the actuator by hand. For example, the user may pull on the actuator with his/her hand until the actuator is sufficiently deformed, so that the engaging piece is removed from the latching row, i.e., is no longer engaged with it.

The elastic material of the actuator allows the actuator to be moved back into its starting position after the force is no longer acting. In particular, the elasticity of the actuator may allow the actuator to return to the blocking position by itself. This allows convenient, reliable operation of the actuator.

The backrest device according to the invention allows an efficient implementation of a height-adjustable backrest on a piece of seating furniture, using relatively few components. In particular, according to the invention only a single additional component, namely, the actuator, is required in addition to the backrest and the backrest carrier. Height adjustment in a piece of seating furniture may thus be provided in a simple manner. In addition, maintenance of the moving parts may thus be carried out efficiently and easily. Furthermore, such a one-piece implementation requires relatively little space.

The backrest preferably has a support arm bracket, the backrest being mounted on the backrest carrier in that the support arm of the backrest carrier is supported in the support arm bracket of the backrest. If the backrest has a frame, the support arm bracket may be provided on or in the frame. Such an embodiment having a support arm bracket in which the support arm is situated allows stable movement of the backrest along the backrest carrier. In addition, this allows a simple design of the backrest device in a stable configuration.

The backrest carrier is preferably equipped with a further support arm on which the backrest is mounted, wherein the further support arm is equipped with a further latching row, and the actuator has a further engaging piece with which the further engaging piece of the actuator engages with the further latching row of the further support arm of the backrest carrier in the blocking position, and in the movement position the further engaging piece of the actuator is disengaged from the further latching row of the further support arm of the backrest carrier, and in the movement position the actuator is elastically deformed by the manually applied force in such a way that the further engaging piece of the actuator is pulled out of the further latching row of the further support arm of the backrest carrier.

Thus, via the same preferably manually applied force, the engaging piece and the further engaging piece together may be moved or pulled out of the latching row and the further latching row.

The further support arm may in particular extend approximately parallel to the support arm. This allows a relatively simple, robust, and stable design. In particular, the two support arms allow the backrest to be stably supported, but still tiltable to a certain extent in a lateral direction. The backrest may thus allow movement by the user in a different direction.

The backrest preferably has a further support arm bracket, the backrest being mounted on the backrest carrier by supporting the further support arm of the backrest carrier in the further support arm bracket of the backrest.

The actuator preferably has a grip section for manually actuating the actuator in particular into the movement position. Such a grip section allows simple and efficient manual operation of the actuator. The actuator preferably includes two arm sections on which one of the engaging pieces and one of the further engaging pieces is situated in each case. The two arm sections may be shaped and dimensioned corresponding to the support arms of the backrest carrier. The grip section of the actuator preferably connects the two arm sections of the actuator to one another. Other areas between the arm sections may in particular have an open design. The actuator may thus be essentially U-shaped in a top view. Such a grip section allows simple operation of the actuator. In particular, the two engaging pieces may be pulled out together from the two latching rows.

The arm sections of the actuator preferably each have a first longitudinal end and a second longitudinal end, each of the arm sections in the area of its first longitudinal end being fixed to the backrest, and in the area of its second longitudinal end having one of the engaging pieces and one of the further engaging pieces. This allows efficient implementation and operation of the actuator. The arm sections of the actuator at the first longitudinal ends preferably each include a fixing structure with an insertion pin having a quasi-T-shaped cross section and a locking pin, and the backrest includes two insertion openings, associated in each case with one of the insertion pins, with an insertion area and a fixing area, and two locking openings, each of which is associated with a locking pin.

The insertion openings of the backrest are preferably dimensioned in the insertion area in such a way that the insertion pins of the fixing structure of the arm sections of the actuator pass through, and in the fixing area are dimensioned in such a way that neck sections of the insertion pins of the fixing structure of the arm sections of the actuator pass through, and head sections of the insertion pins of the arm sections of the actuator do not pass through. The term "neck section" in conjunction with the insertion pins having a T-shaped cross section may refer in particular to the base section of the T shape. Analogously, the term "head section" in conjunction with the insertion pins having a T-shaped cross section may refer in particular to the cap section of the T shape. In other words, the insertion pins may each include a neck or base section and a head or cap section. The insertion opening may be shaped and dimensioned in such a way that the head section passes through the insertion area of the insertion opening, but not through its fixing area. The insertion pins may thus be guided through the insertion areas of the insertion openings for mounting the actuator to the backrest. The insertion pins may subsequently be moved along the insertion openings until they extend through the fixing areas. At this point, the head sections can no longer be moved out of the insertion openings, and the actuator is fastened to the backrest.

The locking pins of the fixing structure of the arm sections of the actuator are preferably situated in the locking openings when the insertion pins of the fixing structure of the actuator are situated in the fixing areas of the insertion openings of the backrest, and the locking pins of the fixing structure of the actuator are situated outside the locking openings when the insertion pins of the fixing structure of the actuator are situated in the insertion areas of the insertion openings of the backrest. Such a design allows the locking pins to hold the insertion pins in the fixing areas of the insertion openings. Removal of the insertion pins from the insertion openings and removal of the actuator from the backrest may thus be prevented.

The support arm bracket of the backrest preferably has a quasi-sleeve-shaped design, the support arm of the backrest carrier being inserted into the support arm bracket of the backrest. Such a sleeve-shaped support arm bracket may allow stable and efficient mounting of the backrest on the backrest carrier. In addition, the backrest mounted on the backrest carrier may thus be moved along the support arm with smooth guiding. In designs having a backrest carrier with two support arms, the further support arm bracket likewise advantageously has a sleeve-shaped design.

The latching row of the support arm of the backrest carrier is preferably situated inside the support arm bracket, the support arm bracket of the backrest having an engagement opening that is formed adjacent to the latching row of the support arm of the backrest carrier, and the actuator being mounted on the support arm brackets of the backrest in such a way that in the blocking position, the engaging piece of the actuator extends through the engagement opening of the support arm bracket of the backrest. This may allow an efficient, simple design.

The actuator is preferably made of a plastic. Such an actuator may be manufactured precisely in a cost-effective manner. In addition, it may thus have the required elasticity.

The backrest device preferably has a lock that prevents the backrest from being removed or being removable from the backrest carrier when the actuator is in the movement position. The lock may have a movement-limiting means for the actuator, and a stop. The movement-limiting means may include a structure that limits the extent of movement of the actuator. As a result, the engaging piece may be pulled out of the latching row up to a predefined location or position, and no farther. The stop may be placed adjacent to the latching row or at one end thereof. The stop may be dimensioned in such a way that the engaging piece of the actuator does not pass by the actuator in any operating position thereof. The stop may thus prevent removal of the actuator, and the backrest carrier connected to it, from the backrest carrier. Such a lock may prevent improper operation of the backrest device and in particular, unintentional removal of the backrest from the backrest carrier.

BRIEF DESCRIPTION OF THE DRAWINGS

Further advantageous embodiments of the invention result from the following description of exemplary embodiments of the invention, with the aid of the schematic drawings. In particular, the backrest device according to the invention is explained in greater detail based on exemplary embodiments, with reference to the appended drawings, which show the following.

APPROACH(ES) TO CARRYING OUT THE INVENTION

Figure 1:
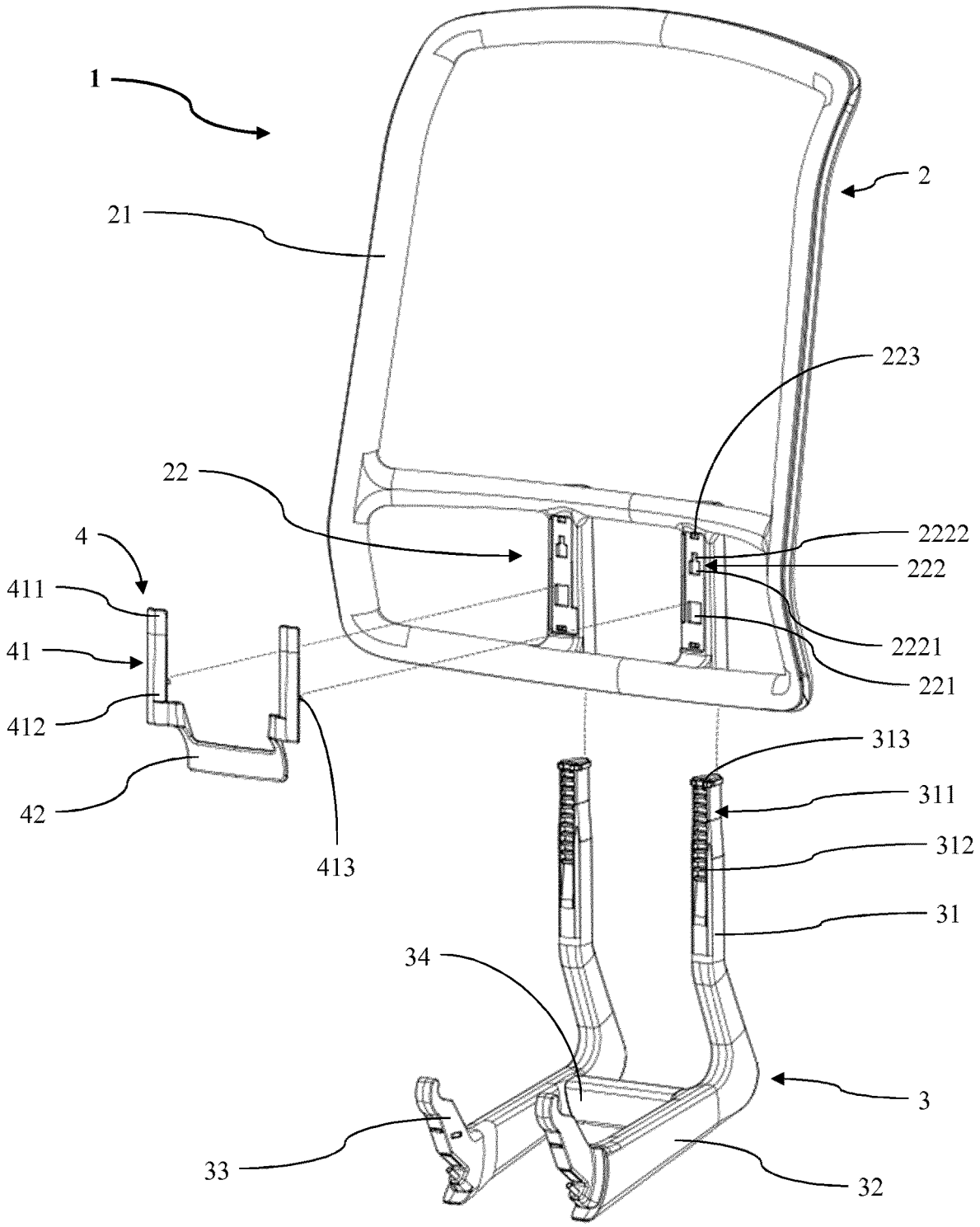
FIG. 1 shows a perspective exploded view of one exemplary embodiment of a backrest device according to the invention.

Certain expressions are used in the following description for practical reasons, and are not to be construed as limiting. The words "right," "left," "bottom," and "top" denote directions in the drawings to which reference is made. The expressions "inwardly," "outwardly," "below," "above," "left," "right," or the like are used to describe the arrangement of denoted parts relative to one another, the movement of denoted parts relative to one another, and the directions toward or away from the geometric midpoint in the invention as well as designated parts thereof, as illustrated in the figures. These spatial relative indications also encompass other positions and orientations than illustrated in the figures. For example, when a part illustrated in the figures is turned upside down, elements or features that are described as "below" are then "above." The terminology includes the words expressly mentioned above, derivations of same, and words of similar meaning.

To avoid repetitions in the figures and the associated description of the various aspects and exemplary embodiments, certain features are to be understood collectively for various aspects and exemplary embodiments. The omission of an aspect in the description or in a figure does not imply that this aspect is absent in the associated exemplary embodiment. Rather, such an omission may serve to improve clarity and prevent repetitions. In this regard, the following applies for the entire further description: If reference numerals are contained in a figure for the purpose of graphical clarity, but are not mentioned in the directly corresponding text in the description, reference should be made to their explanation in the preceding description of the figures. Furthermore, if reference numerals are mentioned in the text in the description that directly corresponds to a figure, but are not contained in the associated figure, reference should be made to the preceding and subsequent figures. Similar reference numerals in two or more figures stand for similar or identical elements.

FIG. 1 shows one exemplary embodiment of a backrest device 1 according to the invention for an office chair. The backrest device 1 includes a backrest carrier 3, a backrest 2, and an actuator 4 or a button. The backrest carrier 3 has two support arms 31 that are oriented vertically and in parallel. Each support arm 31 merges into a horizontally oriented connecting arm 32 via an angled piece. The two parallel connecting arms 32 are joined together and fixed to one another via a cross member 34. At their longitudinal ends facing away from the angled pieces, the connecting arms 32 are each equipped with a mounting structure 33 via which the backrest carrier 3 may be fastened to a seat support or a base element of the office chair. The two vertical support arms 31 of the backrest carrier 3 are each equipped with a row of teeth 311, as a latching row, that extends from bottom to top and is oriented toward the front. The rows of teeth each have a plurality of teeth 312 that are spaced apart by gaps. Adjacent to and above the row of teeth 311, each of the support arms 31 has a stop 313 of a lock.

The backrest 2 includes a frame 21 in which a support structure, for example a textile substrate, may be planarly stretched. In addition, the backrest has two parallel, vertically oriented support arm brackets 22 that are fastened between two horizontal sections. The support arm brackets 22 have a quasi-sleeve-shaped design and have an inner space. On a front side, the two support arm brackets 22 are similarly equipped with three vertically spaced openings via which the inner space of the associated support arm bracket 22 is accessible. In particular, the support arm brackets 22 each have a lower rectangular engagement opening 221, an upper, likewise rectangular locking opening 223 but with smaller dimensions, and a middle insertion opening 222. The insertion openings 222 are each designed with a lower rectangular insertion area 2221 and a fixing area 2222 that extends upwardly therefrom in the manner of a slot.

The actuator 4 has a one-piece design, and includes two parallel, vertically oriented arm sections 41, each having an upper first longitudinal end 411 and a lower second longitudinal end 412. The two arm sections 41 are connected to one another via a grip section 42 in such a way that they are spaced apart from one another corresponding to the distance from the support arm brackets 22 or the support arms 31. Near their second longitudinal ends 412, the two arm sections 41 are each equipped with an engagement tab 413, as an engaging piece, that extends in the direction of the backrest 2.

Figure 2:
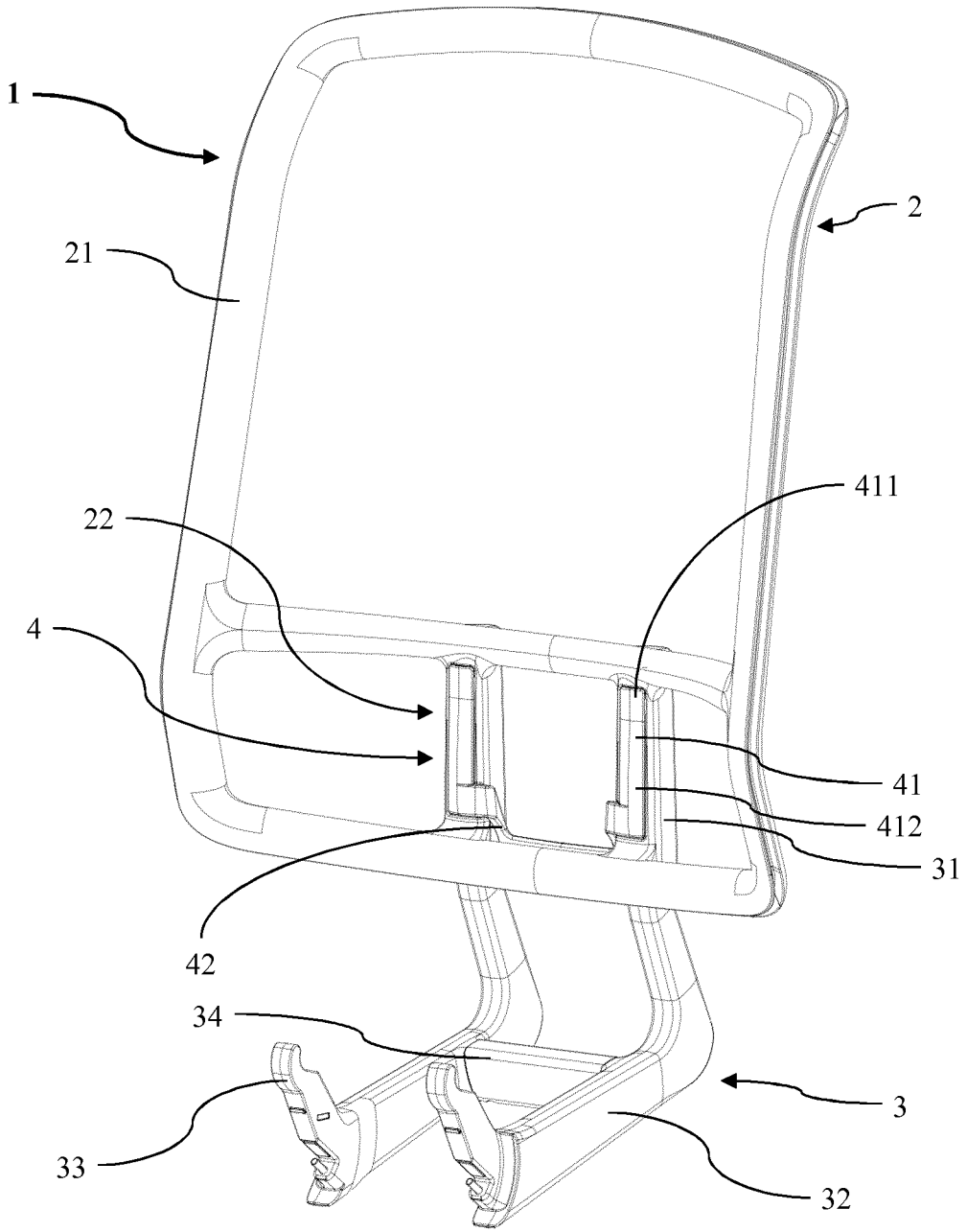
FIG. 2 shows a perspective view of the backrest device from FIG. 1.

In the assembled state shown in FIG. 2, the support arms 31 of the backrest carrier 3 are inserted from below into the two support arm brackets 22 of the backrest 2. The support arms 31 are hereby situated in the inner spaces of the support arm brackets 22. The actuator 4, as described in greater detail below, is fastened to the backrest 2 from the front, and cooperates with the support arms 31 as described in greater detail below.

Figure 3:
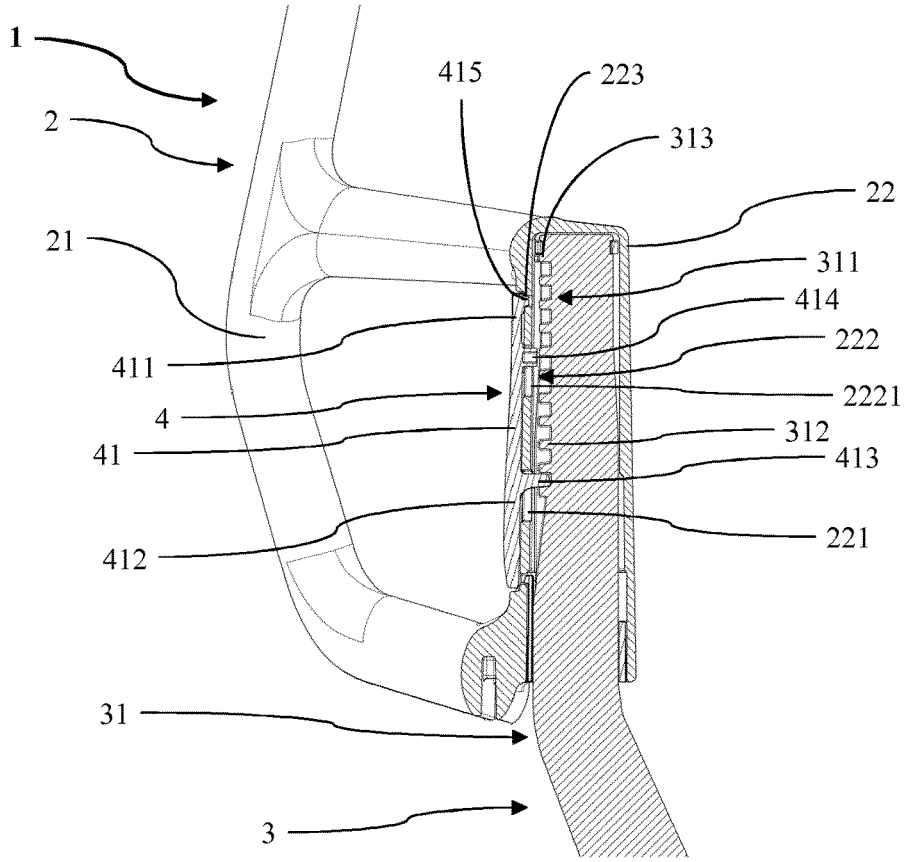
FIG. 3 shows a cross-sectional view of the backrest device from FIG. 1 in a lower blocking position.
Figure 4:
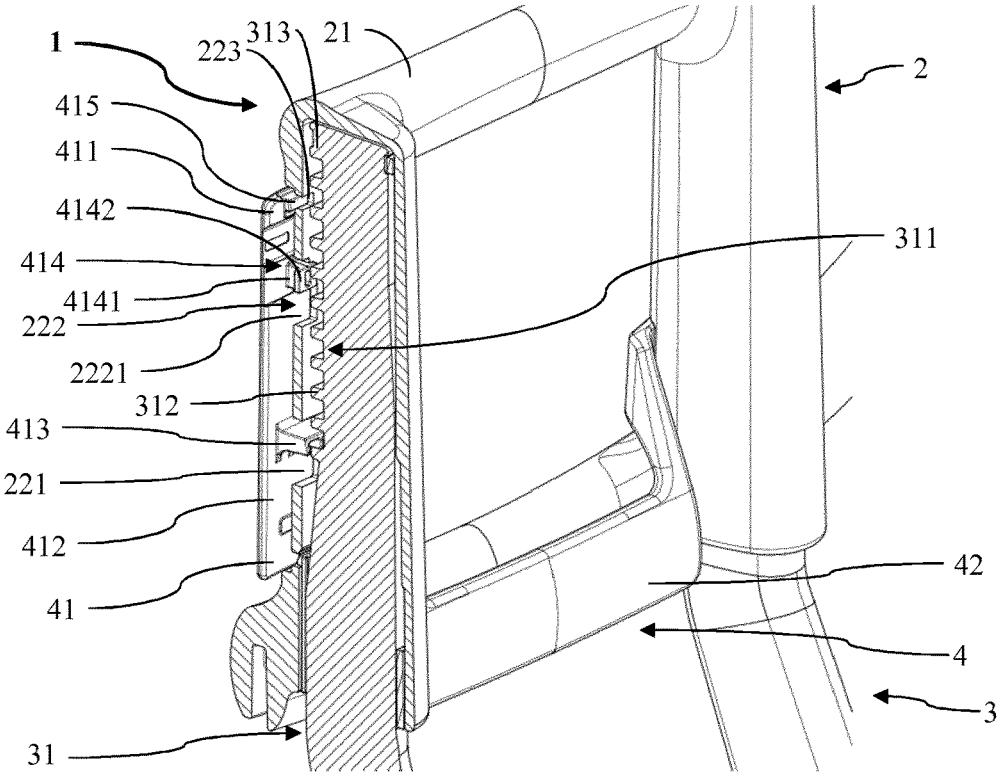
FIG. 4 shows a perspective cross-sectional view of the backrest device from FIG. 1 in the lower blocking position.

FIGS. 3 and 4 show the backrest device 1 in a lower blocking position. Each of the arm sections 41 of the actuator 4 is situated on one of the support arm brackets 22 of the backrest 2. Near their first longitudinal ends 411, the arm sections 41 are each equipped with a locking pin 415 that extends in the direction of the support arm bracket 22 and engages with the locking opening 223 of the associated support arm bracket 22. In the position corresponding to the insertion opening 222 of the associated support arm bracket 22, each of the arm sections 41 is also equipped with an insertion pin 414 that extends in the direction of the support arm bracket 22. The locking pins 415 and the insertion pins 414 together form a fixing structure of the actuator 4.

As is apparent in FIG. 4, the insertion pins 414 have a quasi-T-shaped design in a horizontal cross section, and each include a head section 4142 and a neck section 4141. For mounting the actuator 4 on the backrest 2, the insertion pins 414 are pressed into the insertion areas 2221 of the insertion openings 222 of the support arm brackets 22. The arm sections 41 must be bent for this purpose. The head sections 4142 are thus situated in the inner space of the support arm brackets 22, and the neck sections 4141 extend outwardly through the insertion openings 222. The actuator 4 is then pushed upwardly until the neck sections 4141 of the insertion pins 414 of the arm sections 41 are situated in the fixing areas 2222 of the insertion openings 222 of the support arms 22. The head sections 4142 are still situated in the inner space of the support arms 22, and due to their size they cannot pass outwardly through the fixing areas 2222 of the insertion openings 222. The arm sections 41 of the actuator are thus fixed to the support arm brackets 22 of the backrest 2. At the same time, the locking pins 415 of the arm sections 41 are also snapped into the locking openings 223 of the support arm brackets 22. In this way, downward displacement of the actuator 4 is blocked and the actuator 4 is fixedly locked to the backrest.

In the lower blocking position shown in FIGS. 3 and 4, the engagement tabs 413 of the arm sections 41 of the actuator 4 engage through the engagement openings 221 of the support arm brackets 22 of the backrest 2, into the rows of teeth 311 of the support arms 31 of the backrest carrier 3. In particular, the engagement tabs 413 are each situated in the gap between the two lowermost teeth 312. The backrest 2 is thus in a lowest position on the backrest carrier 3. A vertical movement of the backrest 2 relative to the backrest carrier 3 is blocked by the actuator 4.

Figure 5:
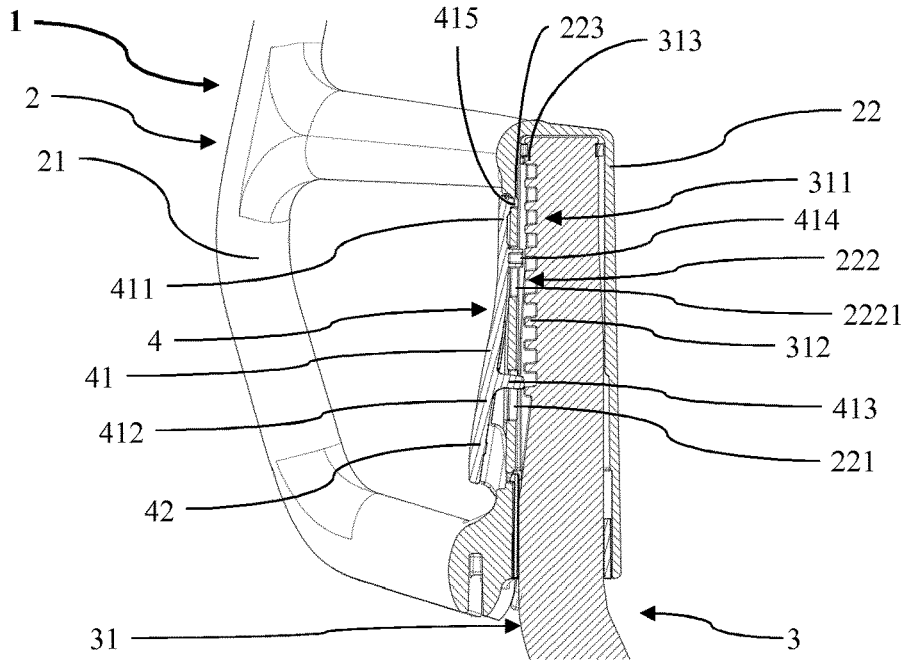
FIG. 5 shows a cross-sectional view of the backrest device from FIG. 1 in a lower movement position.

FIG. 5 shows the backrest carrier device 1 and its actuator 4 in a movement position. The grip section 42 is manually pulled away from the support arm brackets 22 of the backrest 2. Since the arm sections 41 of the actuator 4, as described above, are fixedly locked to the support arm brackets 22, the actuator 4 is elastically bent to the left. The engagement tabs 413 are hereby disengaged from the rows of teeth 311 of the support arms 31 of the backrest carrier 3. The support arm brackets 22 may now be moved along the support arms 31 in the vertical direction. The entire backrest 2 may thus be displaced vertically relative to the backrest carrier 3, and a height of the backrest 2 may be adjusted. The upper end areas of the support arms 31 are dimensioned in such a way that the support arm brackets 22 cannot be lifted upwardly from the backrest carrier 3.

As is apparent in FIGS. 4 and 5, a lower crossbar of the frame 21 of the backrest 2 limits movement or bending of the actuator 4. In particular, the grip section 42 abuts against the crossbar when the former is moved to a predefined extent out of the blocking position. The crossbar together with the grip section 42 thus forms a movement-limiting means of the lock. In addition, the projections 313 each protrude beyond teeth 312 of the associated row of teeth 311 to the left, or until the associated engaging piece 413 of the actuator 4 abuts against them when the backrest 2 is moved upwardly in the release position. As a result, each of the engaging pieces 413 may be pulled out of the associated latching row 311 up to a predefined location or position, in which they are moved sufficiently to the left that they are able to pass by the associated row of teeth 311, but not the associated projection 313. The backrest 2 is thus secured to the backrest carrier 3 by means of the lock, and cannot be inadvertently removed therefrom.

Figure 6:
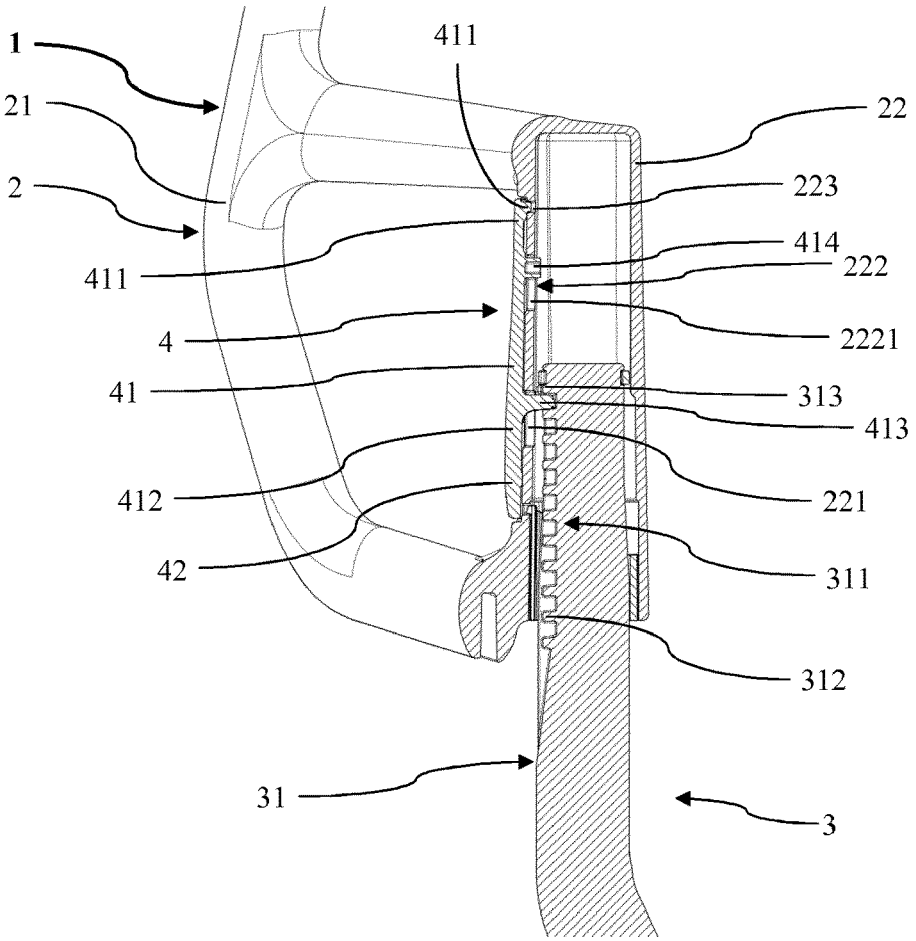
FIG. 6 shows a cross-sectional view of the backrest device from FIG. 1 in an upper movement position.

FIG. 6 shows the backrest carrier device 1 in an upper blocking position. The grip section 42 of the actuator 4 is released, so that the arm sections 41 once again rest against the support arm brackets 22 due to the inherent elasticity of the actuator 4. The engagement tabs 413 of the arm sections 41 engage through the engagement openings 221 of the support arm brackets 22, into the rows of teeth 311 of the support arms 31 of the backrest carrier 3. In particular, each of the engagement tabs 413 is situated in the gap between the two uppermost teeth 312. The backrest 2 is thus in a highest position on the backrest carrier 3. A vertical movement of the backrest 2 relative to the backrest carrier 3 is blocked by the actuator 4.

Although the invention is illustrated and described in detail by means of the figures and the associated description, respectively, this illustration and this detailed description are to be understood as illustrative and by way of example, and not as limiting to the invention. In certain cases, well-known structures and techniques may not be shown or described in detail so as not to overelaborate the invention. It is understood that experts in the field may make revisions and modifications without departing from the scope of the following claims. In particular, the present invention encompasses further exemplary embodiments with any combinations of features, which may differ from the feature combinations explicitly described.

The present disclosure also includes embodiments with any combination of features that are stated or shown in the preceding or subsequent discussion of various embodiments. The present disclosure likewise includes individual features in the figures, even if they are shown there in conjunction with other features, and/or are not mentioned in the preceding or subsequent discussion. In addition, the alternatives of embodiments and individual alternatives of their features that are described in the figures and in the description may be excluded from the subject matter of the invention or the disclosed subject matter. The disclosure includes embodiments that comprise only the features described in the claims or in the exemplary embodiments, as well as embodiments that comprise additional other features.

In addition, the expression "include" and derivations thereof does not exclude other elements or steps. Likewise, the indefinite article "a" or "an" does not exclude a plurality. The functions of multiple features stated in the claims may be met by one unit or one step. The terms "essentially," "approximately," "about," and the like in conjunction with a property or a value in particular also define the exact property or the exact value. The terms "approximately" and "about" in conjunction with a given numerical value or range may refer to a value or range that is within 20%, within 10%, within 5%, or within 2% of the given value or range.

What is claimed is:

1. A backrest device for a piece of seating furniture, in particular an office chair, comprising:

a backrest carrier having a first support arm and a second support arm, a backrest mounted on the first and second support arms, and an actuator that is adjustable between a blocking position and a movement position, wherein the first support arm of the backrest carrier is equipped with a first latching row and the second support arm of the backrest carrier is equipped with a second latching row, the actuator is connected to the backrest, the actuator including a first arm section having a first longitudinal end fixed to the backrest and a second longitudinal end on which a first engaging piece is situated, and a second arm section having a first longitudinal end fixed to the backrest and a second longitudinal end on which a second engaging piece is situated, in the blocking position, the first engaging piece of the actuator is configured to engage with the first latching row of the first support arm of the backrest carrier and the second engaging piece of the actuator is configured to engage with the second latching row of the second support arm of the backrest carrier, so that a movement of the backrest along the first and second support arms of the backrest carrier is blocked, in the movement position, the first engaging piece of the actuator is configured to disengage from the first latching row of the first support arm of the backrest carrier and the second engaging piece of the actuator is configured to disengage from the second latching row of the second support arm of the backrest carrier, so that the backrest is movable along the first and second support arms of the backrest carrier, and the actuator is manufactured in one piece from an elastic material, and in the movement position the actuator is configured to be elastically deformed by a force, so that the first and second engaging pieces of the actuator are moved out of the first and second latching rows of the first and second support arms of the backrest carrier.

2. The backrest device according to claim 1, wherein the backrest has a first support arm bracket, the backrest being mounted on the backrest carrier such that the first support arm of the backrest carrier is supported in the first support arm bracket of the backrest, and wherein the backrest has a second support arm bracket, the second support arm of the backrest carrier being supported in the second support arm bracket of the backrest.

3. The backrest device according to claim 2, wherein the first support arm bracket of the backrest has a sleeve-shaped design, the first support arm of the backrest carrier being inserted into the first support arm bracket of the backrest.

4. The backrest device according to claim 3, wherein the first latching row of the first support arm of the backrest carrier is situated inside the first support arm bracket, the first support arm bracket of the backrest having an engagement opening that is formed adjacent to the first latching row of the first support arm of the backrest carrier, and the actuator being mounted on the first support arm bracket of the backrest in such a way that in the blocking position, the first engaging piece of the actuator extends through the engagement opening of the first support arm bracket of the backrest.

5. The backrest device according to claim 4, wherein the second support arm bracket of the backrest has a sleeve-shaped design, the second support arm of the backrest carrier being inserted into the second support arm bracket of the backrest.

6. The backrest device according to claim 5, wherein the second latching row of the second support arm of the backrest carrier is situated inside the second support arm bracket, the second support arm bracket of the backrest having an engagement opening that is formed adjacent to the second latching row of the second support arm of the backrest carrier, and the actuator being mounted on the second support arm bracket of the backrest in such a way that in the blocking position, the second engaging piece of the actuator extends through the engagement opening of the second support arm bracket of the backrest.

7. The backrest device according to claim 1, wherein the actuator has a grip section for manually actuating the actuator.

8. The backrest device according to claim 7, wherein the grip section of the actuator connects the first and second arm sections of the actuator to one another.

9. The backrest device according to claim 1, wherein the first and second arm sections of the actuator at the first longitudinal ends each include a fixing structure with an insertion pin having a T shaped cross section and a locking pin, and the backrest includes two insertion openings, associated in each case with one of the insertion pins, with an insertion area and a fixing area, and two locking openings, each of which is associated with a locking pin.

10. The backrest device according to claim 9, wherein the insertion openings of the backrest in the insertion area are dimensioned in such a way that the insertion pins of the fixing structure of the first and second arm sections of the actuator pass through, and in the fixing area are dimensioned in such a way that neck sections of the insertion pins of the fixing structure of the first and second arm sections of the actuator pass through, and head sections of the insertion pins of the first and second arm sections of the actuator do not pass through.

11. The backrest device according to claim 10, wherein the locking pins of the fixing structure of the actuator are situated in the locking openings when the insertion pins of the fixing structure of the actuator are situated in the fixing areas of the insertion openings of the backrest, and the locking pins of the fixing structure of the actuator are situated outside the locking openings when the insertion pins of the fixing structure of the actuator are situated in the insertion areas of the insertion openings of the backrest.

12. The backrest device according to claim 1, wherein the actuator is made of a plastic.

13. The backrest device according to claim 1, further comprising a lock that prevents the backrest from being removed from the backrest carrier when the actuator is in the movement position.

* * * * *